United States Patent [19]

Nguyen

[11] Patent Number: 5,044,081

[45] Date of Patent: Sep. 3, 1991

[54] CARPET TRIMMER WITH A RECESSED GUIDE

[75] Inventor: Tan D. Nguyen, Milpitas, Calif.

[73] Assignee: Crain Cutter Co., Inc., Milpitas, Calif.

[21] Appl. No.: 560,096

[22] Filed: Jul. 30, 1990

[51] Int. Cl.[5] ..... B26B 21/00

[52] U.S. Cl. ..... 30/294; 30/289

[58] Field of Search ..... 30/294, 286, 287, 289, 30/288

[56] References Cited

U.S. PATENT DOCUMENTS

| | | | |
|---|---|---|---|
| 2,233,497 | 3/1941 | Teigen | 30/289 |
| 2,274,978 | 3/1942 | Currier | 164/73 |
| 2,666,986 | 1/1954 | Codianne | 30/293 |
| 2,772,474 | 12/1956 | Hill et al. | 30/293 |
| 3,605,267 | 9/1971 | Brenner | 30/287 |
| 3,934,341 | 1/1976 | Carlson | 30/287 |
| 4,064,627 | 12/1977 | Zanfini | 30/287 |
| 4,095,341 | 6/1978 | Crain | 30/287 |
| 4,833,956 | 5/1989 | Roberts | 30/294 |

*Primary Examiner*—Mark Rosenbaum
*Assistant Examiner*—Allan M. Schrock
*Attorney, Agent, or Firm*—Jack M. Wiseman

[57] ABSTRACT

A carpet cutter for trimming the edge of a carpet in which a base of the carpet cutter includes a flat bottom plate for movement along the carpet. The base also includes an angularly disposed upper plate spaced from the bottom plate to form an angular recess facing an installed molding. The angular recess receives a projecting edge on the installed molding to guide the carpet cutter along the installed molding during the cutting of the carpet. The free bottom edge of bottom plate is received by a recess in the molding to guide the carpet cutter along the installed molding during the cutting of the carpet. A handle is attached to the base and extends upwardly therefrom. The handle carries blades for cutting the carpet edge during the guided movement of the carpet cutter along the molding.

10 Claims, 3 Drawing Sheets

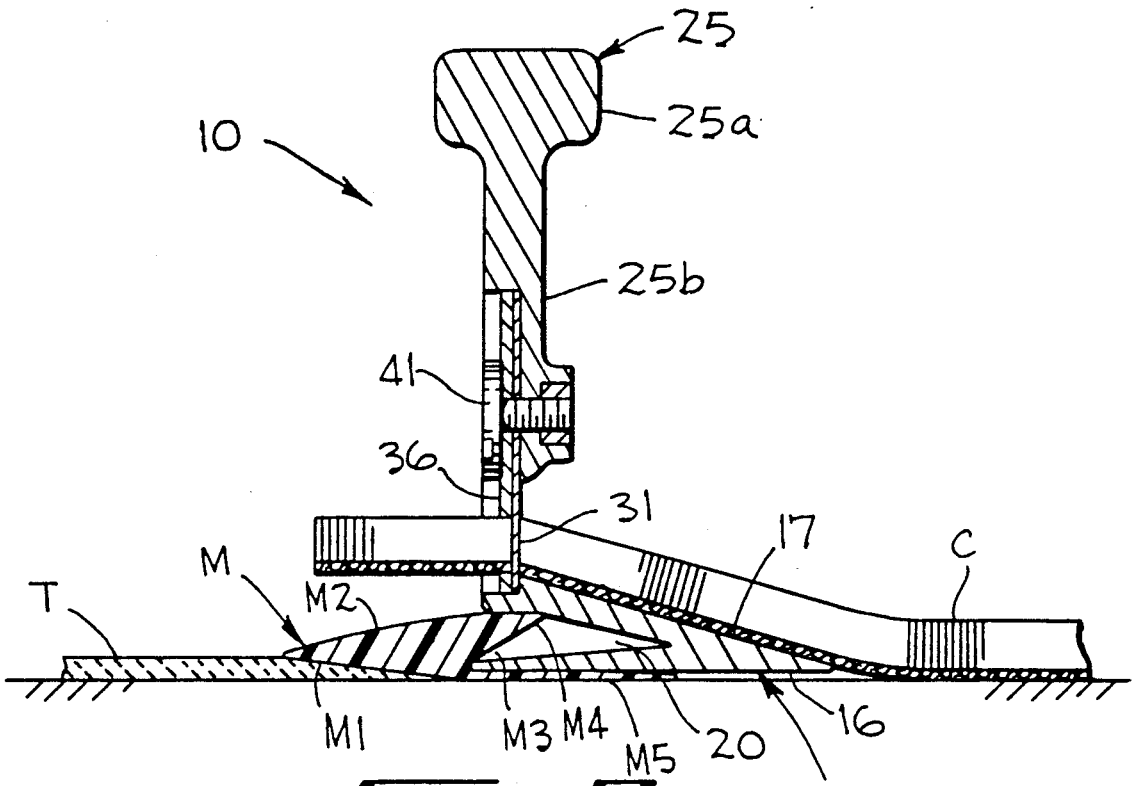
fig_6
fig_7
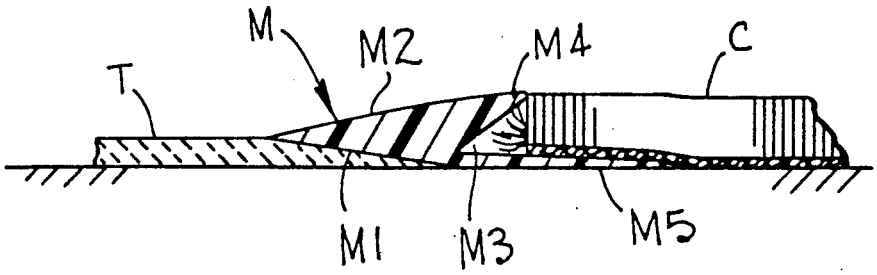

CARPET TRIMMER WITH A RECESSED GUIDE

BACKGROUND OF THE INVENTION

The present invention relates in general to tools for the installation of carpets, and more particularly to a carpet cutting tool for the installation of carpets.

In the installation of carpets, carpet finishing molding may be used to provide a smooth transition from the carpet to other floors. The edge of the carpet is trimmed to conform to the contour of the base edge of the molding. Heretofore, it has been relatively difficult to trim satisfactorily the edge of a carpet. If the toe of the carpet edge remaining after trimming were too full, the carpet edge may buckle. If the toe of the carpet edge remaining after trimming were cut short, the appearance of the carpet would not be satisfactory.

In the U.S. Pat. to Codianne, No. 2,666,986, issued on Jan. 26, 1954, for Carpet Cutting Device, there is disclosed a carpet cutter in which a top plate has a downwardly extending guide member abutting against a wall to guide the cutter in its cutting movement. The front end portion of the top plate is formed with an angular slot for receiving the upwardly extending turned portion of the carpet to be trimmed.

The U.S. Pat. to Hill et al., No. 2,772,474, granted on Dec. 4, 1956, for Carpet Trimmer, discloses a base plate disposable on the upper surface of a carpet to be trimmed. A vertical blade holder is mounted on the base plate. A guide member is filled to the blade holder for engaging a contiguous wall surface during the cutting of the carpet. Carpet-receiving slots are formed between the guide member and the base plate.

The U.S. Pat. to Brenner, No. 3,605,267, issued on Sept. 20, 1971, for Carpet Trimming Tool, discloses a carpet trimmer with a flat base plate for riding on the nap or pile of a carpet. Mounted to the base plate are oppositely directed cutting blades. The oppositely directed cutting blades are disposed adjacent a guide member.

In the U.S. Pat. to Carlson, No. 3,934,341, issued on Jan. 27, 1976, for Carpet Cutting Tool, there is disclosed a carpet trimmer having a body. A guide is attached to the body and extends in spaced relation to the forward edge of the body to engage a baseboard. A pair of cutting blades is mounted on the forward edge of the body. The trimmer is moved in a direction parallel to the baseboard and parallel to the plane of the cutting blades.

The U.S. Pat. to Zanfini, No. 4,064,627, issued on cutter having a base. A vertical frame is mounted on the base and carries a pair of downwardly diverging blades. The base includes guiding side edges. Horizontal slots are formed in the frame and receive the carpeting to be cut.

In the U.S. Pat. to Crain, No. 4,095,341, issued on June 20, 1978, for a Carpet Trimmer, there is disclosed a carpet trimmer with a base plate. Slots are formed in the base plate at right angles to the working edge of the base plate. Cutting blades are mounted over the base plate. A wall guide depends from a blade holder for the cutting blades in spaced relation to the working edge of the base plate to form a passageway for a carpet edge to be trimmed.

The U.S. Pat. to Currier, No. 2,274,978, issued on Mar. 3, 1942, for Roller Paper Cutter, discloses a roll paper cutter with a hollow cutting bar. The cutting bar has a longitudinally disposed slot. A block is mounted for sliding movement on the cutting bar and has a section projecting through the slot of the cutting bar. A plate projects upwardly from the block and carries inclined cutting blades. A handle moves the block and the cutting blades along the cutting bar for cutting paper disposed across the cutting bar.

SUMMARY OF THE INVENTION

A carpet cutter comprising a base with a bottom member for movement along a carpet to cut the carpet. The base also includes an upper member spaced from the bottom member to form a recess for receiving a projecting edge on an installed molding to guide the carpet cutter along the installed molding during the cutting of the carpet. A handle is attached to the base and extends upwardly therefrom. The handle carries cutting means for cutting a carpet during the guided movement of the carpet cutter along the molding.

A carpet cutter comprising a base for movement along a carpet to cut the carpet. Formed in the base is a projection extending in the direction of travel of the base. The projection is received by a recess formed along the edge of a molding to guide the base along the molding. A handle is attached to the base and extends upwardly therefrom. The handle carries cutting means for cutting a carpet during the guided movement of the carpet cutter along the molding.

A carpet trimmer comprising a base with a flat bottom member for movement along a floor to trim an edge of the carpet. The base also includes an angular member disposed at an angle relative to the bottom member to form an opening for receiving a projecting edge on an installed molding to guide the trimmer along the installed molding during the cutting of the carpet. A handle is attached to the base and extends upwardly therefrom. The handle carries a blade for cutting the carpet during the guided movement of the carpet trimmer along the molding.

A carpet trimmer comprising a base with a flat bottom member for movement along a floor to trim an edge of the carpet. The base also includes an angular member disposed at an angle relative to the bottom member to form an opening for receiving a projecting edge on an installed molding to guide the trimmer along the installed molding extending in the direction of travel of the carpet trimmer for guiding the trimmer along the installed molding during the cutting of the carpet. The upper member of the base rides along the top of the projection edge of the molding during the cutting of the carpet. A handle is attached to the base and extends upwardly therefrom. The handle carries a blade for cutting the carpet during the guided movement of the carpet trimmer along the molding.

An object of the present invention is to provide a carpet trimmer for use along a molding that provides a proper fit. Trim cuts made too full have a tendency to buckle the carpet as the carpet toe edge is forced into the recess on the molding. Trim cuts that are made too short make an unsatisfactory appearance.

Another object of the present invention is to provide a carpet trimmer for use along a curved molding that cuts a satisfactory trim.

A feature of the present invention is that a carpet trimmer has a base with a recess extending in the direction of the movement of the carpet trimmer during the cutting operation which receives a projection along the edge of the molding to guide the carpet trimmer along the molding during the cutting operation.

Another feature of the present invention is that a carpet trimmer has a base with a projection extending in the direction of the movement of the carpet trimmer during the cutting operation that is received by a recess formed along the edge of the molding to guide the carpet trimmer along the molding during the cutting operation.

Another feature of the present invention is that a carpet trimmer has a base with a recess and a projection extending in the direction of travel of the carpet trimmer to receive and to project into associated projection and recess formed in a molding to be guided thereby in its movement along the edge of the molding during the cutting of a carpet.

Another feature of the present invention is a carpet trimmer with an integrally formed base and handle for lending itself to a single molding operation in the production thereof and requiring only the attachment of cutting means.

Another feature of the present invention is a carpet trimmer with an integrally formed base having an integrally formed guide for guiding the movement of the carpet trimmer during the cutting of a carpet and an integrally formed handle for lending itself to a single molding operation in the production thereof and requiring only the attachment of cutting means.

Another feature of the present invention is that a carpet trimmer is capable of being guided along a curved edge of a molding during the cutting operation.

BRIEF DESCRIPTION OF THE DRAWINGS

FIG. 6 is a diagrammatic vertical section view taken in a transverse direction of the carpet trimmer shown in FIGS. 1-3 and 5 illustrated with a molding and a carpet to be trimmed.

FIG. 7 is a diagrammatic illustration of carpet trimmed by the carpet trimmer embodying the present invention and shown with a molding that is disposed adjacent a different floor.

DESCRIPTION OF THE PREFERRED EMBODIMENT

Figure 1:
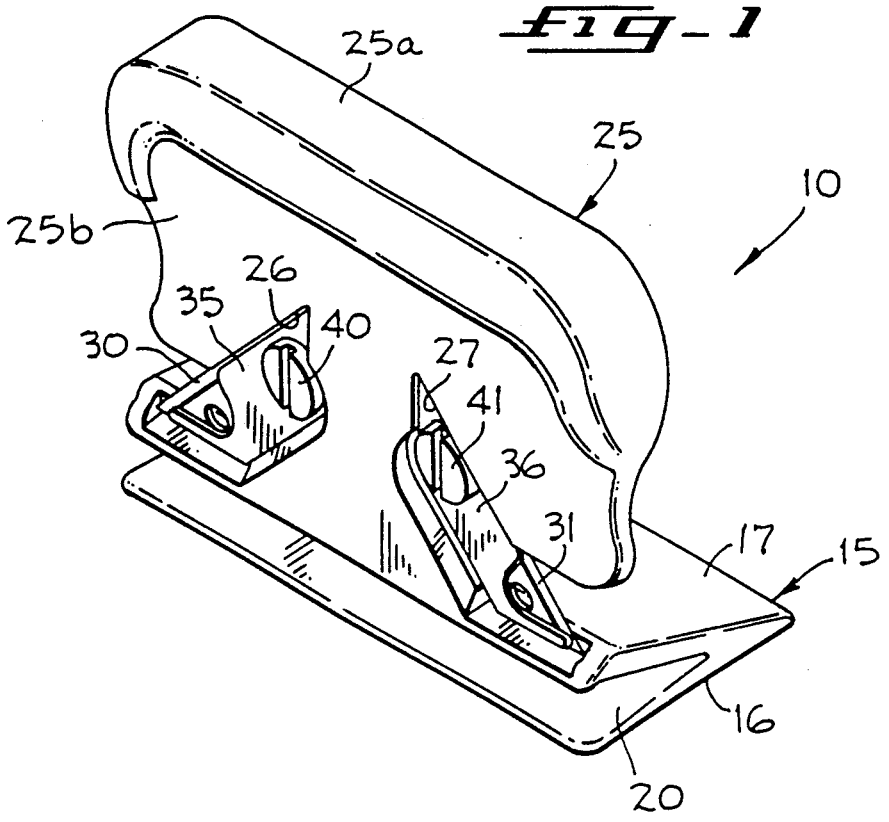
FIG. 1 is a front perspective view of a carpet trimmer embodying the present invention.
Figure 2:
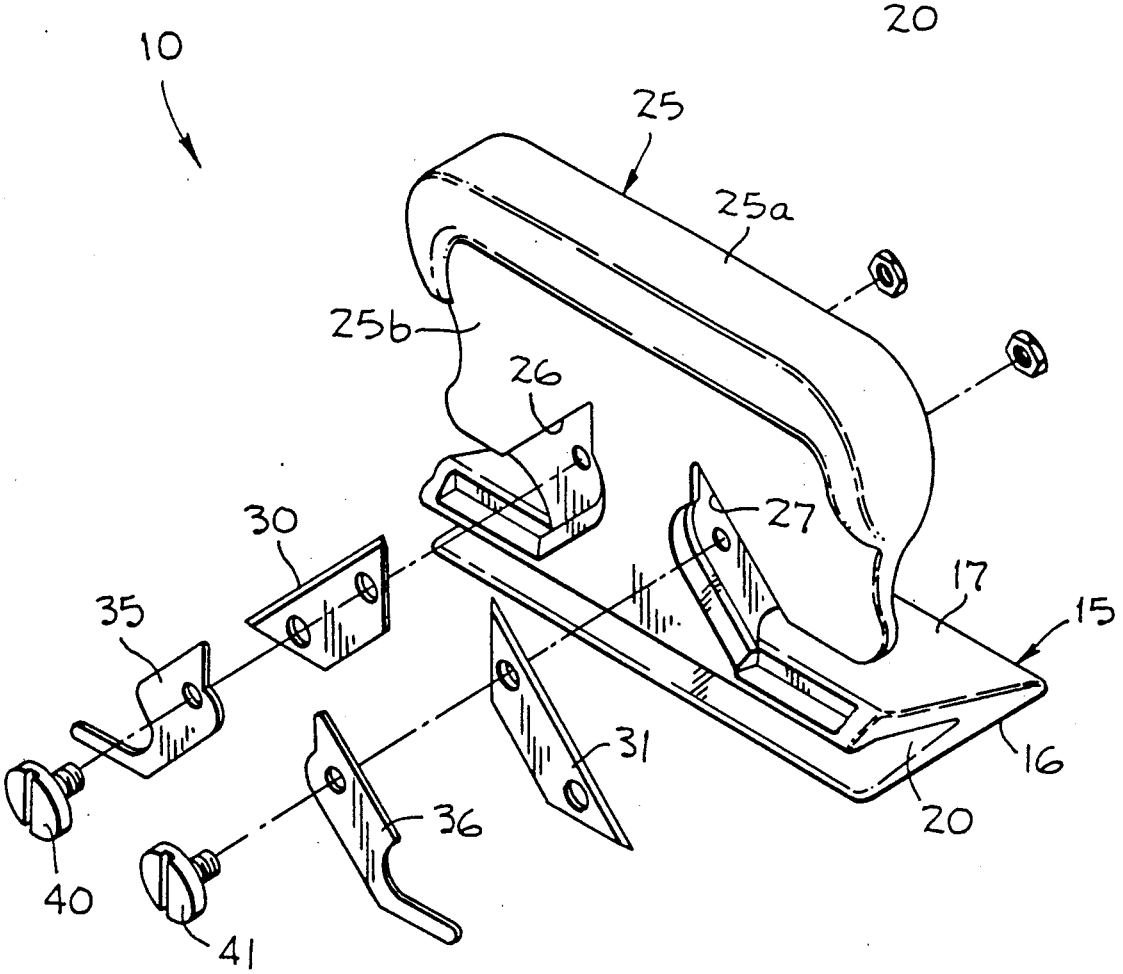
FIG. 2 is an exploded view of the carpet trimmer shown in FIG. 1.

Illustrated in FIGS. 1 and 2 is a carpet cutter or a carpet trimmer 10 embodying the present invention. The carpet trimmer 10 comprises a base 15 having a flat bottom wall 16 and an angularly disposed upper wall 17. The bottom wall 16 and the angularly disposed wall 17 form a recess 20. The recess 20 extends in the direction of movement of the carpet trimmer 10 during the carpet cutting operation. In the exemplary embodiment, the recess 20 is an angular opening. More particularly, the recess 20 has a V-shaped configuration in cross section. The base 15 is made of a suitable rigid material, such as plastic. In the exemplary embodiment, the base 15 is made of a fiberglass filled polyester plastic.

Figure 3:
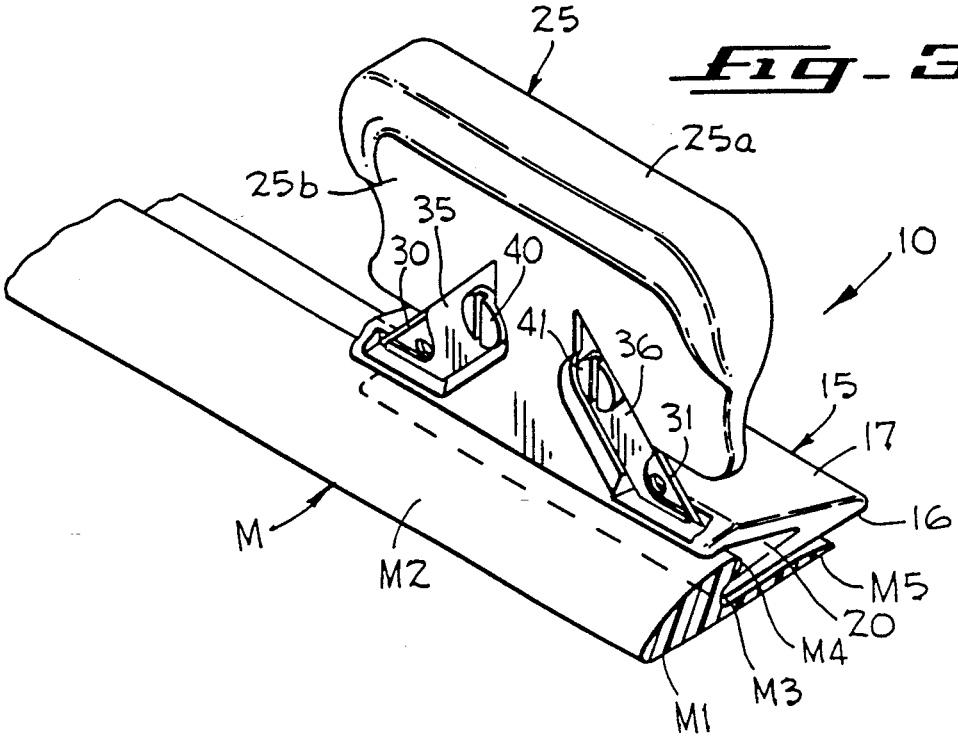
FIG. 3 is a front perspective view of the carpet trimmer shown in FIGS. 1 and 2 illustrated in conjunction with a molding.

A conventional molding M (FIG. 3) comprises a flat bottom wall Ml and an angularly disposed upper wall M2. The molding M is fixedly installed on a floor for separating different floors, such as carpet, tile, linoleum or the like. The bottom wall Ml and the angularly disposed wall M2 form a recess M3 that extends in the direction of travel of the carpet trimmer 10 during the cutting operation. Along the end of the angularly disposed wall M2 facing the end of the carpet to be trimmed is a projection or edge M4 of the molding M extending in the direction of travel of the carpet trimmer 10 during the cutting operation. The molding M could be rectilinear or could have a curved configuration when viewed along the edge thereof facing the carpet to be trimmed.

During the cutting operation, the projection M4 of the molding M is disposed within the recess 20 of the carpet trimmer 10 to guide the movement of the carpet trimmer 10 along the molding M. In a similar manner, the free end of the bottom member 16 of the base 15 is disposed within the recess M3 of the molding M to guide the movement of the carpet trimmer 10 along the molding M during the carpet cutting operation. The edge of the angularly disposed member 17 overlying the opening 20 slides along the top of the projection M4 of the molding M during the cutting operation for guiding the carpet trimmer 10. The base 16 of the carpet trimmer 10 slides along an apron M5 of the bottom wall Ml to guide the movement of the carpet trimmer 10 during the cutting operation.

Extending upwardly from the base 15 of the carpet trimmer 10 is a handle and blade holder 25 (FIGS. 1 and 2). In the preferred embodiment, the handle and blade holder 25 is integrally formed with the base 15 along the edge of the angularly disposed member 17 confronting the molding M. In the preferred embodiment, the handle and blade holder 25 is made of the same rigid material as is the base 15 and extends upwardly therefrom at right angles. The handle and blade holder 25, as viewed in confronting relation to the carpet, has a generally T-shaped configuration. The handle and blade holder 25 comprises a handle 25*a* and a blade holder 25*b*.

The handle and blade holder 25 is formed with oppositely directed, angularly disposed recesses 26 and 27. Disposed within the recesses 26 and 27 are suitable cutting means, such as cutting blades 30 and 31. The blades 30 and 31 are disposed within a vertical plane. Lock plates 35 and 36 are disposed within the recesses 26 and 27, respectively, outboard of the blades 30 and 31, respectively. Screws 40 and 41 removably secure the blades 30 and 31, respectively, and the lock plates 35 and 36, within the recesses 26 and 27, respectively.

Figure 4:
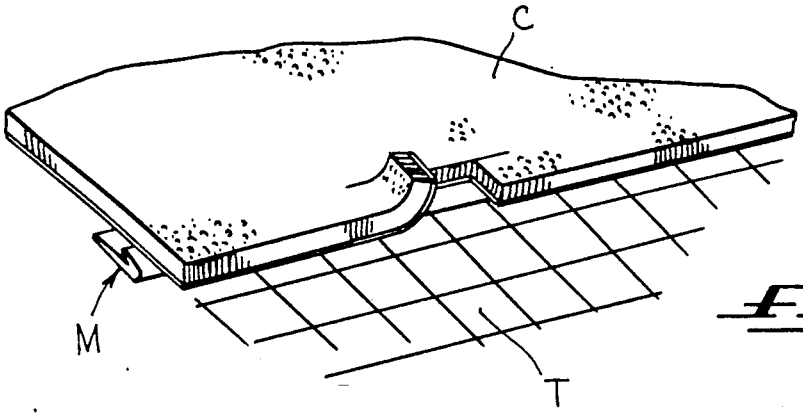
FIG. 4 is a diagrammatic illustration of a carpet to be trimmed shown with a molding that is disposed adjacent a different floor.

In the use of the carpet trimmer 10, a short T-shaped entry cut is made in a carpet C centrally of a defined area, such as the center of a doorway (FIG. 4). The molding M extends across the defined area, such as the center of a doorway. The molding M can be made of vinyl or metal and serves to protect the carpet edge against raveling and traffic; to hold the carpet end in place and to provide a smooth transition from the carpet to another floor. FIGS. 4-7 illustrate the molding M forming a smooth transition from the carpet C to another floor, such as tiles T.

Figure 5:
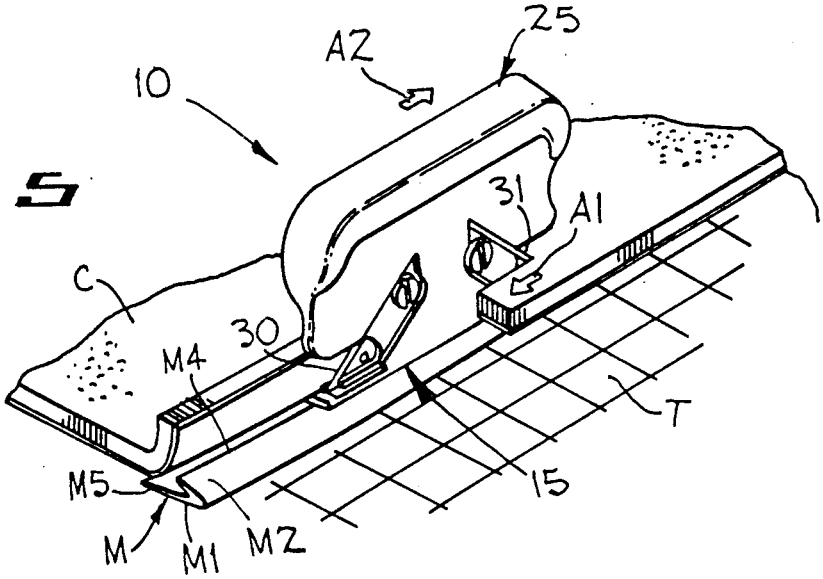
FIG. 5 is a diagrammatic illustration of the carpet trimmer shown in FIGS. 1-3 and illustrated with a carpet to be trimmed shown with a molding that is disposed adjacent a different floor.

The carpet trimmer 10 is inserted into a T-shaped entry (FIGS. 4 and 5). The carpet trimmer 10 is urged against the molding M to trim the carpet C in the direction of an arrow Al (FIG. 5) and then is reversed to trim the carpet C in an opposite direction shown by an arrow A2 (FIG. 5). When the carpet C is being trimmed, the edge thereof to be cut overlies the molding M and the angular disposed member 17 of the carpet trimmer 10 and is disposed in the path of one of the cutting blades dependent on the direction of the cutting operation. The carpet edge is cut to conform to the configuration of the confronting edge M4 of the molding M as viewed in the direction of the edge M4 of the carpet C being cut. For installation of the carpet C, the trimmed carpet edge will extend slightly into the recess M3 (FIG. 7).

What is claimed is:

1. A carpet cutter for trimming a carpet edge to conform to the contour of an edge of a molding, the edge of the molding being formed with a projection extending in the direction of the carpet edge to be trimmed, said carpet cutter comprising:

(a) a base formed with a recess extending in the direction of the carpet edge to be trimmed for receiving the projection of the edge of the molding to guide said base along the edge of the molding, said base comprising a bottom member and an angularly disposed member, said angularly disposed member overlying said bottom member, said angularly disposed member having a lower wall and an upper wall, said bottom member and the lower wall of said angularly disposed member forming said recess in said base for receiving the projection of the edge of the molding to guide said base along the edge of the molding, said recess forming an angular opening facing the molding to receive the projection of the edge of the molding, said upper wall of said angularly disposed member being arranged for the carpet edge to be trimmed to be disposed thereover;

(b) cutting means holder extending upwardly along said base for imparting movement to said base along the edge of the molding;

(c) a handle attached to said cutting means holder for moving said cutting means holder and said base in the direction of the carpet edge to be trimmed; and (d) cutting means carried by said holder for trimming the carpet edge during the guided movement of said base.

2. A carpet trimmer as claimed in claim 1 wherein said opening has a generally V-shape.

3. A carpet trimmer as claimed in claim 1 wherein said angularly disposed upper member has an edge overlying the projection of said molding for sliding along the projection of the edge of the molding.

4. A carpet trimmer as claimed in claim 1 wherein said molding being formed with a recess extending in the direction of the edge of the carpet to be trimmed and below the projection of the edge of the molding, said bottom member of said base being received by said recess of said molding for guiding said base along the edge of the molding.

5. A carpet trimmer as claimed in claim 3 wherein said molding being formed with a recess extending in the direction of the edge of the carpet to be trimmed and below the projection of the edge of the molding to guide the base along the edge of the molding, said molding having a bottom wall forming an apron below the projection of the edge of the molding and forming a recess, said bottom member of said base being received by recess of said molding and sliding along said apron of said bottom wall of said molding for guiding said base in its movement along the edge of the molding.

6. A carpet cutter as claimed in claim 1 wherein said base, said cutting means holder, and said handle are integrally formed.

7. A carpet cutter for trimming a carpet edge to conform to the contour of an edge of a molding, the edge of the molding being formed with a recess extending in the direction of the carpet edge to be trimmed, said carpet cutter comprising:

(a) a base formed with a projection extending in the direction of the carpet edge to be trimmed to be received by the recess formed in the molding to guide the base along the edge of the molding, said base being formed with a bottom member forming said projection received by the recess formed in the molding to guide the base along the edge of the molding, said molding including a projection extending in the direction of the carpet edge to be trimmed, said base being formed with an upper member for sliding along said projection of said molding during the guided movement of said base along the edge of said molding;

(b) cutting means holder extending upwardly from said base for imparting movement to said base along the edge of the molding;

(c) a handle attached to said cutting means holder for moving said cutting means holder and said base in the direction of the carpet edge to be trimmed; and (d) cutting means carried by said holder for trimming the carpet edge during the guided movement of the base.

8. A carpet cutter as claimed in claim 7 wherein said cutting means holder and said handle are perpendicular to said flat bottom member.

9. A carpet cutter as claimed in claim 8 wherein said cutting means holder and said handle form a T-shaped arrangement.

10. A carpet cutter as claimed in claim 8 wherein said cutting means are in the form of oppositely directed blades disposed in vertical plane passing through said cutting means holder and said handle.

* * * * *